US006131732A

United States Patent [19]

Schneider

[11] Patent Number: 6,131,732

[45] Date of Patent: Oct. 17, 2000

[54] FOAM DRINK TRAY WITH IMPROVED CUP CAVITIES

[76] Inventor: Paul W. Schneider, 2919 N. Mill Rd., Oconomowoc, Wis. 53066

[21] Appl. No.: 09/283,519

[22] Filed: Apr. 1, 1999

[51] Int. Cl.[7] ..... A45C 11/20

[52] U.S. Cl. ..... 206/217; 206/560; 206/523

[58] Field of Search ..... 206/217, 509, 206/523, 560, 564; 264/293, 321; 229/904

[56] References Cited

U.S. PATENT DOCUMENTS

| | | | |
|---|---|---|---|
| 3,942,671 | 3/1976 | Florian | 206/564 |
| 4,684,013 | 8/1987 | Jacobs | 206/564 |
| 5,421,459 | 6/1995 | Mazzotti | 206/564 |
| 5,429,231 | 7/1995 | McSpadden | 206/217 |
| 5,607,077 | 3/1997 | Torkelson | 206/217 |
| 5,971,139 | 10/1999 | Bradley | 206/217 |

*Primary Examiner*—Bryon P. Gehman
*Assistant Examiner*—Luan K. Bui
*Attorney, Agent, or Firm*—Donald J. Ersler

[57] ABSTRACT

A foam drink tray having improved cup cavities includes a foam base with at least two cup cavities disposed in a top thereof for retaining cups or cans. At least one hand cavity may be formed in a top thereof for the retention by a hand. The side wall of each cup cavity may be shaped several different ways. However, every side wall surface which contacts a cup or can must be chamfered where it meets the top of the tray. The gas escape hole is disposed in the mold such that it is on the chamfer. The hand cavity may be any convenient shape which allows a hand to firmly retain the foam drink tray. A gas relief vent may be formed in one a mold half to facilitate improved flow of foam throughout the mold.

13 Claims, 8 Drawing Sheets

FOAM DRINK TRAY WITH IMPROVED CUP CAVITIES

BACKGROUND OF THE INVENTION

1. Field of the Invention

The present invention relates generally to trays and more specifically to a foam drink tray with improved cup cavities which allows a plurality of cups to be securely retained and a plurality of foam drink trays to be stacked without damage.

2. Discussion of the Prior Art

A problem frequently encountered with foam drink trays is damage incurred by stacking. The cavities formed in the tray to retain a cup or can must have a gas escape hole disposed near the perimeter of the cup cavity. Unfortunately, the top of the tray will have a nub protrusion left when the tray is taken out of the mold. The nub protrusion in a bottom tray will cause a hole to be formed in on the bottom surface of the top tray which is stacked above the bottom tray. The hole formed by the nub protrusion will be cosmetically unacceptable to a consumer.

A second problem with a cup cavity is the side wall which contacts a cup. Insertion of a cup into cup cavity with a straight side wall sometimes causes the cup side wall to deflect. The deflection of the cup side wall will force the contents of the cup through the cap, causing a spill of the cup contents.

Accordingly, there is a clearly felt need in the art for a foam drink tray with improved cup cavities which eliminates the deleterious effect of nub protrusions and also allows a cup to be inserted into a cup cavity without the risk of the contents being spilled.

SUMMARY OF THE INVENTION

The primary objective of the present invention is to provide a drink tray with improved cup cavities which eliminates the deleterious effect of nub protrusions and also allows a cup to be inserted into a cup cavity without the risk of the contents being spilled.

According to the present invention, a foam drink tray having improved cup cavities includes a foam base with at least two cup cavities disposed in a top thereof for retaining cups or cans and at least one hand cavity disposed in a top thereof for retention by a hand. The perimeter of each cup cavity may be shaped several different ways. However, every side wall surface portion which contacts a cup or can must be chamfered where it meets the top of the tray. The gas escape hole is disposed such that it aligns with the chamfer. The hand cavity may be any convenient shape which allows a hand to firmly retain the foam drink tray. A gas relief vent may be formed in one a mold half to facilitate improved flow of foam throughout the mold.

Accordingly, it is an object of the present invention to provide a foam drink tray having improved cup cavities which allows thereof to be stacked upon each other without damage.

It is a further object of the present invention to provide a foam drink tray having improved cup cavities which allows a cup to be inserted into a cup cavity without spilling the contents of the cup.

Finally, it is another object of the present invention to provide a foam drink tray having improved cup cavities which may have different shaped perimeters, but still firmly retain a cup or can.

These and additional objects, advantages, features and benefits of the present invention will become apparent from the following specification.

DETAILED DESCRIPTION OF THE PREFERRED EMBODIMENTS

Figure 1:
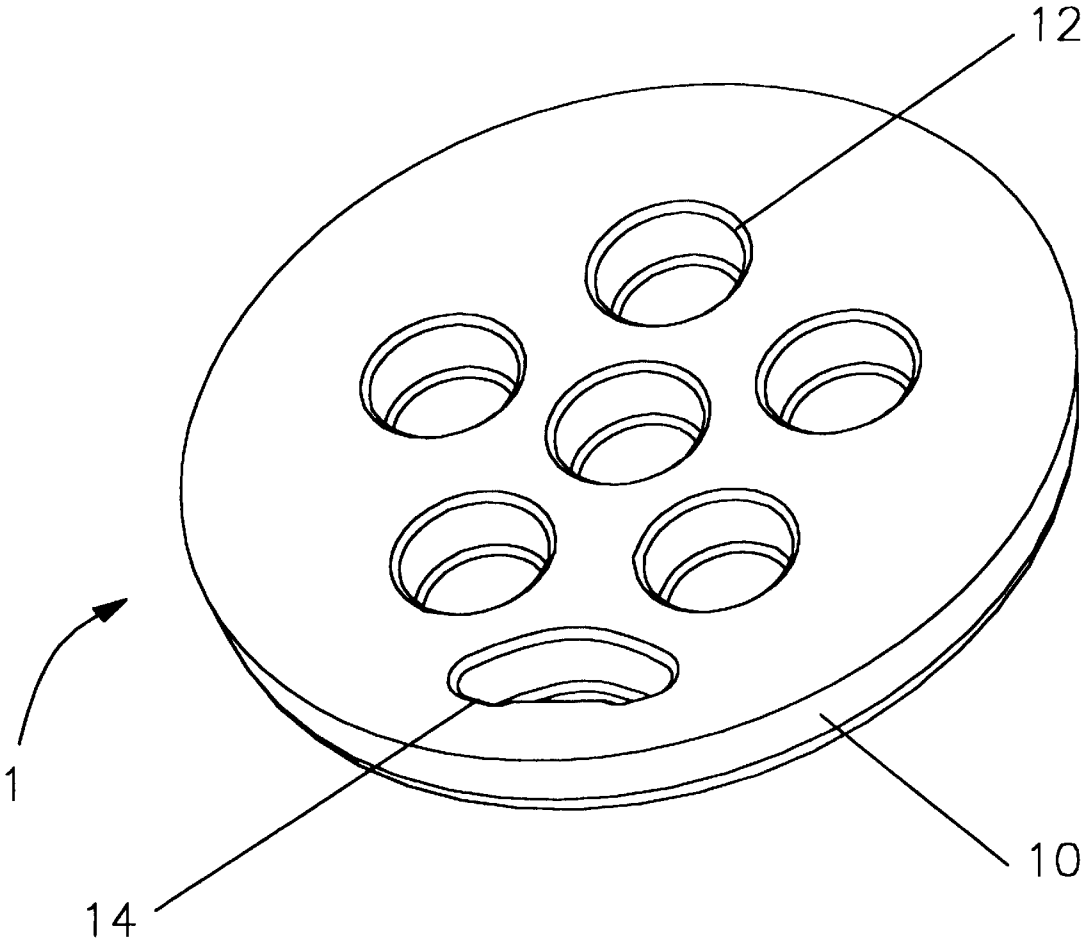
FIG. 1 is a perspective view of a foam drink tray with improved cup cavities in accordance with the present invention.

With reference now to the drawings, and particularly to FIG. 1, there is shown a perspective view of a foam drink tray with improved cup cavities 1. The foam drink tray with improved cup cavities 1 includes a foam base 10 with at least two cup cavities 12 formed in a top for retaining cups or cans. At least one hand cavity 14 may be formed in a top of the foam base 10 at substantially a perimeter thereof. The foam base 10 is preferably fabricated from an open cell foam such as polyurethane or polyethylene. The outer perimeter of the foam base 10 should not be limited to circular or a substantially circular shapes, but should include square, triangular, oval, trapezoidal, any regular or, irregular shapes. The arrangement of the cup cavities 12 should not be limited to that shown in FIG. 1, but could include any number or arrangement.

Figure 2:
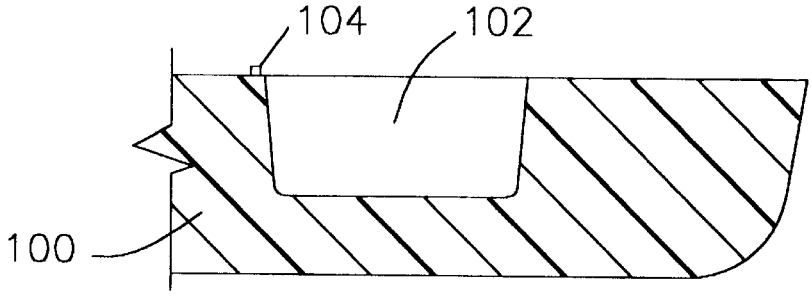
FIG. 2 (PRIOR ART)
FIG. 2 is a cross-sectional view of a cup cavity with a nub protrusion from a prior art tray.
Figure 2A:
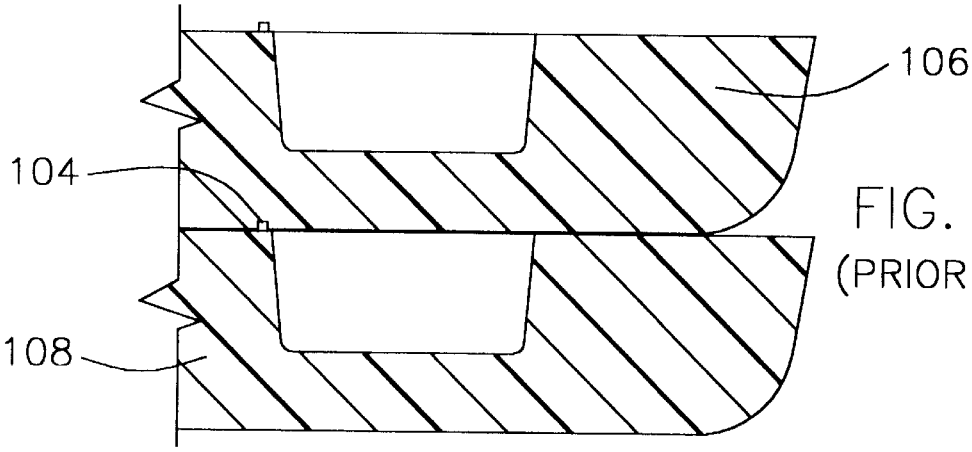
FIG. 2a (PRIOR ART)
FIG. 2*a* is a partial cross-sectional view of a first prior art tray stacked upon a second prior art tray.
Figure 2B:
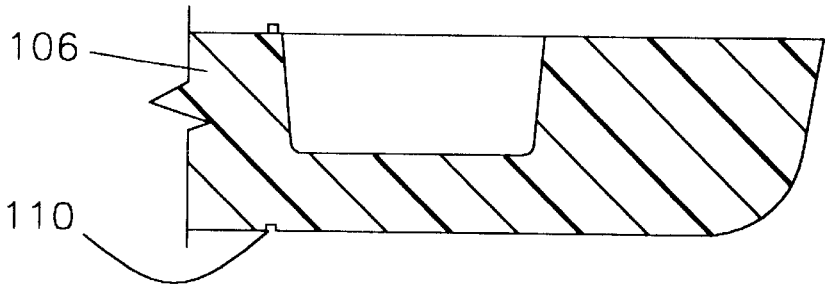
FIG. 2b (PRIOR ART)
FIG. 2*b* is a partial cross-sectional view of the first prior art tray after being stacked upon the second prior art tray for some period of time.
Figure 3:
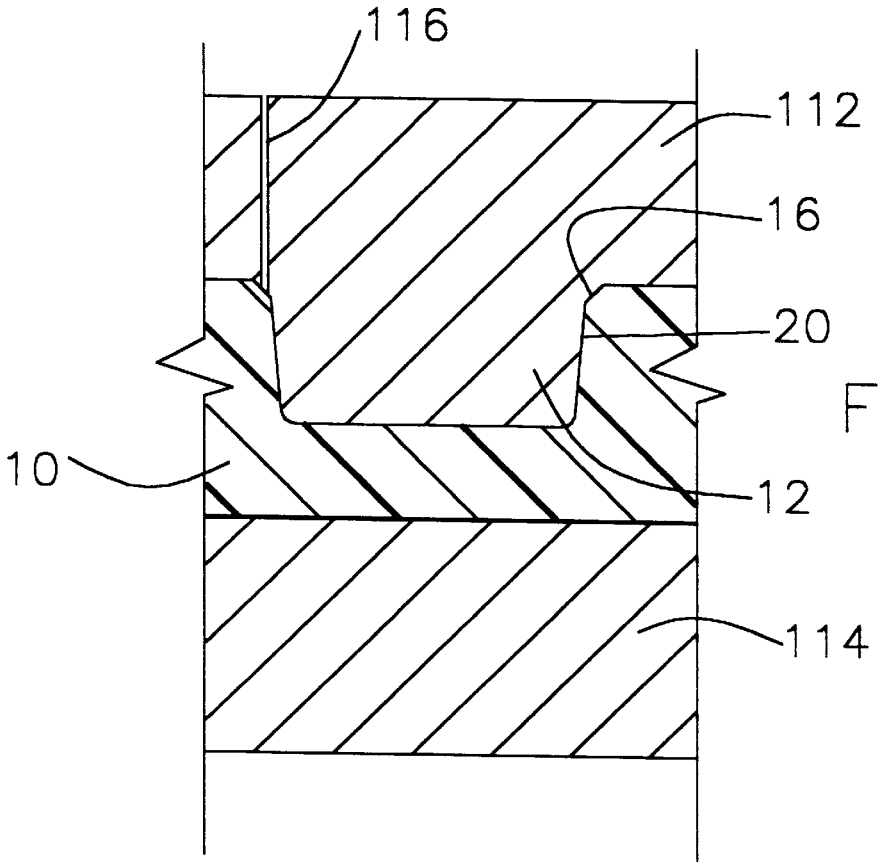
FIG. 3 is a partial cross-sectional view of a foam drink tray being molded with an improved cup cavity in accordance with the present invention.

FIG. 2 shows a cup cavity 102 and a nub protrusion 104 from a prior art foam drink tray 100. FIG. 2*a* shows a first prior art foam drink tray 106 stacked upon a second foam drink tray 108. The second foam drink tray 108 has the nub protrusion 104. The nub protrusion 104 is created by a gas escape hole formed in the mold as shown in FIG. 3. The foam travels up the gas escape hole during molding and must be trimmed or broken off after molding. If a gas escape hole was not formed in the mold, the cup cavity 102 would be grossly deformed. FIG. 2*b* shows the first foam drink tray 106 with a nub hole 110. The nub hole 110 detracts from the aesthetic appearance of an advertising logo which might be silk screened or affixed to a bottom of the first foam drink tray 106.

FIG. 3 shows a cup cavity 12 being molded between an upper mold half 112 and a lower mold half 114. The side wall 20 has a normal draft of 2–3 degrees to facilitate withdrawal of the upper mold half 112. A chamfer 16 is formed on the top perimeter of the cup cavity 12. The chamfer is preferably 45 degrees with a preferably depth of 0.12 to 0.19 inches. A gas escape hole 116 is formed in the upper mold half 112 to allow the cup cavity 12 to be fully formed in the foam drink tray 10.

Figure 3A:
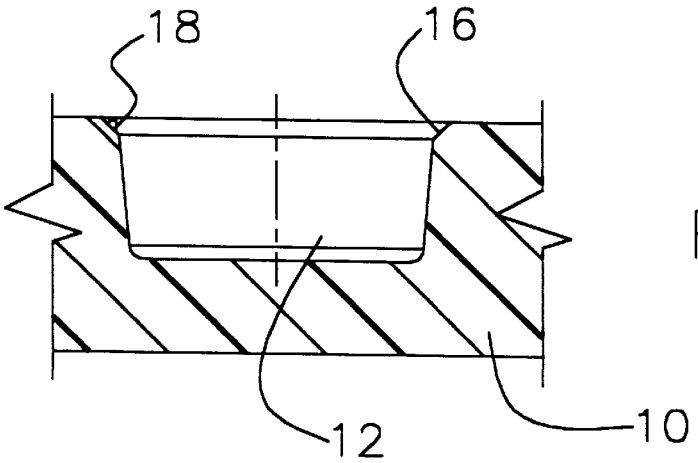
FIG. 3*a* is a partial cross-sectional view of a foam drink tray after being removed from a mold in accordance with the present invention.
Figure 7:
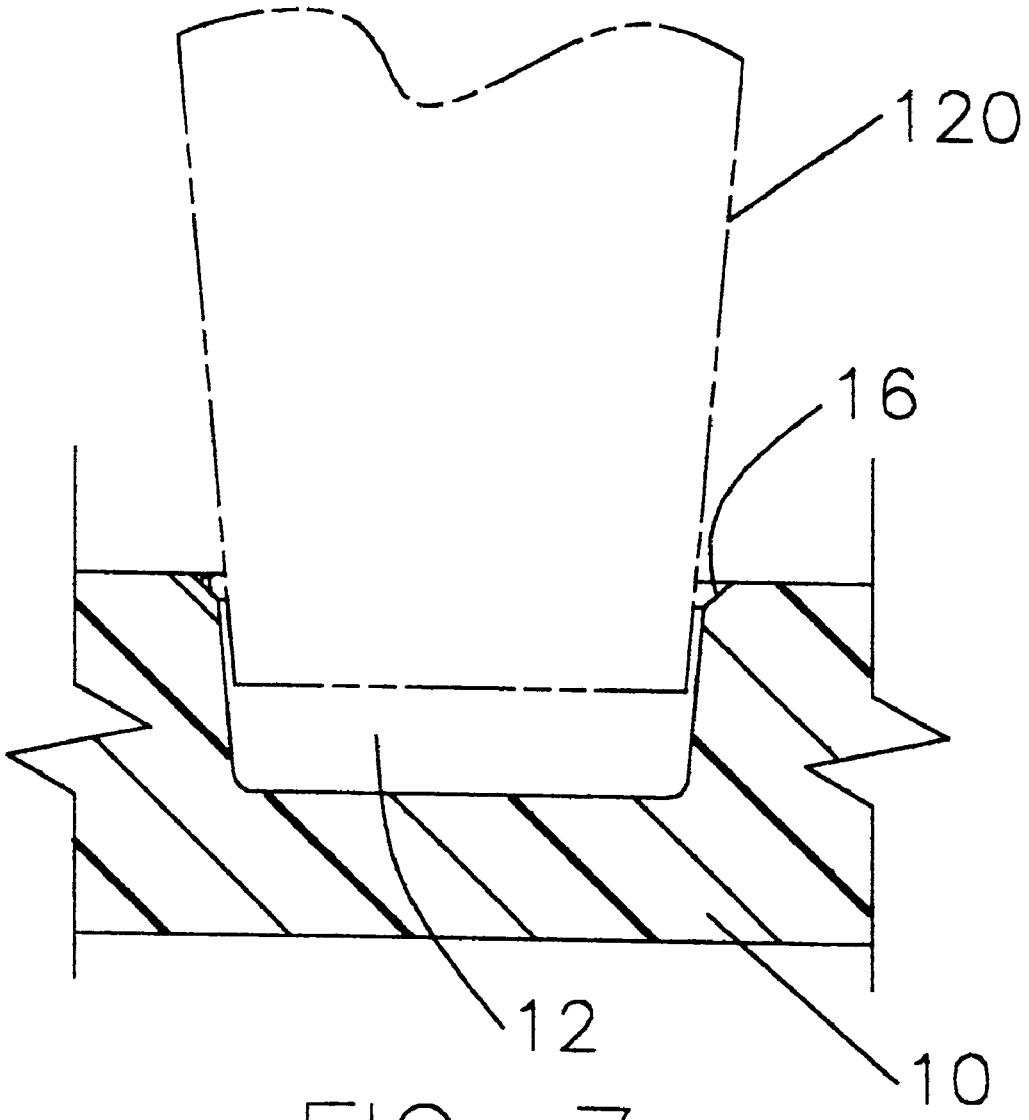
FIG. 7 is a cross-sectional view of a cup being inserted into a cup cavity having a chamfer in accordance with the present invention.

With reference to FIG. 3*a*, the gas escape hole 116 is disposed in the upper mold half 112 such that a nub protrusion 18 is formed on the chamfer 16. The top of the nub protrusion 18 will not reach the top of the foam drink tray 10 after trimming, thus eliminating a nub hole in a second foam drink tray stacked on top of the foam drink tray 10. The chamfer 16 also allows a paper cup 120 to be inserted into the cup cavity 12 without deformation of the paper cup side wall as shown in FIG. 7. The chamfer 16 provides a smooth transition for insertion of a cup into the cup cavity 12. Deformation of a cup side wall will force the paper cup contents out of the paper cup.

Figure 4:
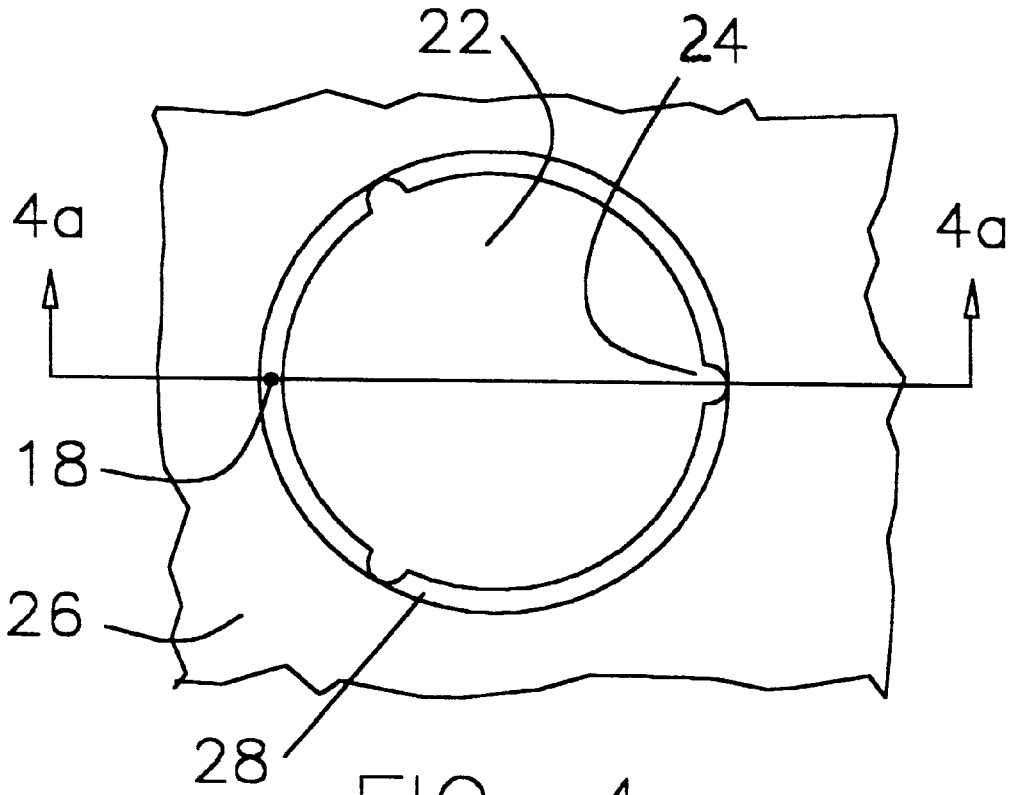
FIG. 4 is a top view of a second preferred embodiment of a cup cavity in accordance with the present invention.
Figure 4A:
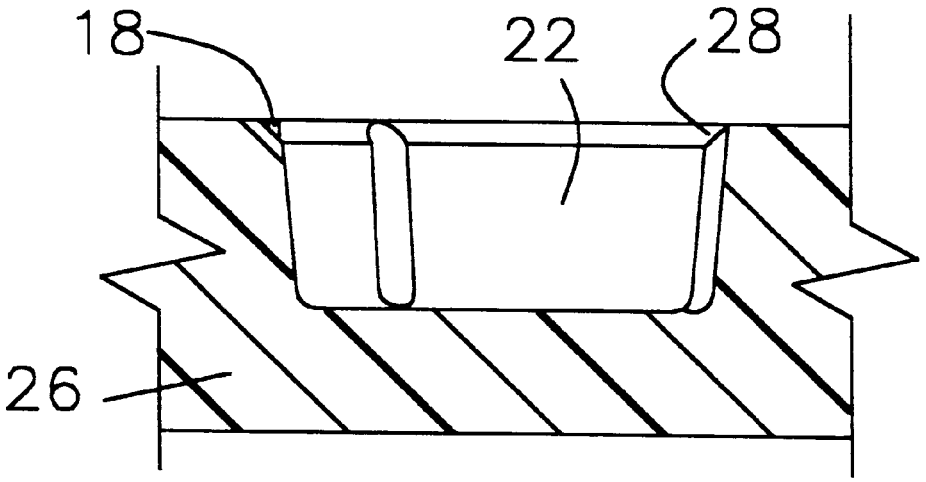
FIG. 4*a* is a cross-sectional view of a second preferred embodiment of a cup cavity in accordance with the present invention.

FIGS. 4 and 4*a* show a second preferred embodiment of a cup cavity 22. The cup cavity 22 includes at least one vacuum release vent 24. The chamfer 28 is formed on the top perimeter of the cup cavity 22 to facilitate the insertion of a cup or can. The vacuum release vent 24 facilitates insertion of a cup or can into the cup cavity 22 by allowing the air which is inside the cup cavity 22 to escape through the vacuum release vent 24 as the cup or can is being inserted. At least two cup cavities 22 are formed in a foam base 26. The nub protrusion 18 is formed on the chamfer 28 to ensure that the top of the nub protrusion 18 after cutting does not reach the top of the foam base 26.

Figure 5:
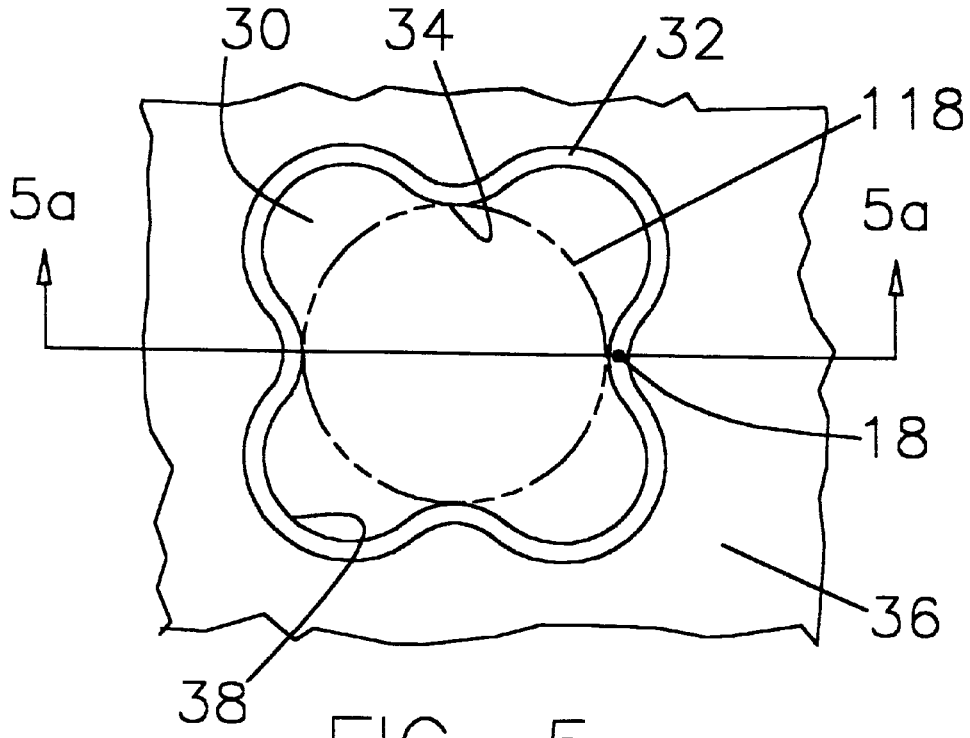
FIG. 5 is a top view of a third preferred embodiment of a cup cavity in accordance with the present invention.
Figure 5A:
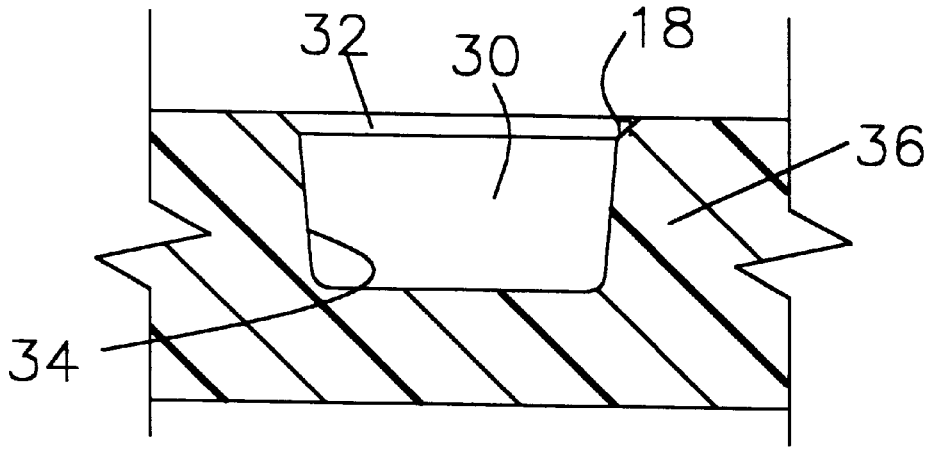
FIG. 5*a* is a cross-sectional view of a third preferred embodiment of a cup cavity in accordance with the present invention.

FIGS. 5 and 5*a* show a third preferred embodiment of a cup cavity 30. A chamfer 32 is preferably formed on the top perimeter of the cup cavity 50 to facilitate the insertion of a cup or can. The shape of the cup cavity perimeter 38 eliminates the need for a vacuum relief vent. Only a small area of the cup cavity 30 contacts the cup or can. The number of curving contacting surfaces 34 are at least three to proper align a cup or can 118 (four are shown in FIG. 5). The shape of the cup cavity perimeter 38 should not be limited to that shown in FIG. 8. The only requirement is that the cup cavity have at least three curving surfaces which contact the can or cup 118. At least two cup cavities 30 are formed in a foam base 36. The nub protrusion 18 may be formed anywhere on the chamfer 32 to ensure that the top of the nub protrusion 18 after cutting does not reach the top of the foam base 36.

Figure 6:
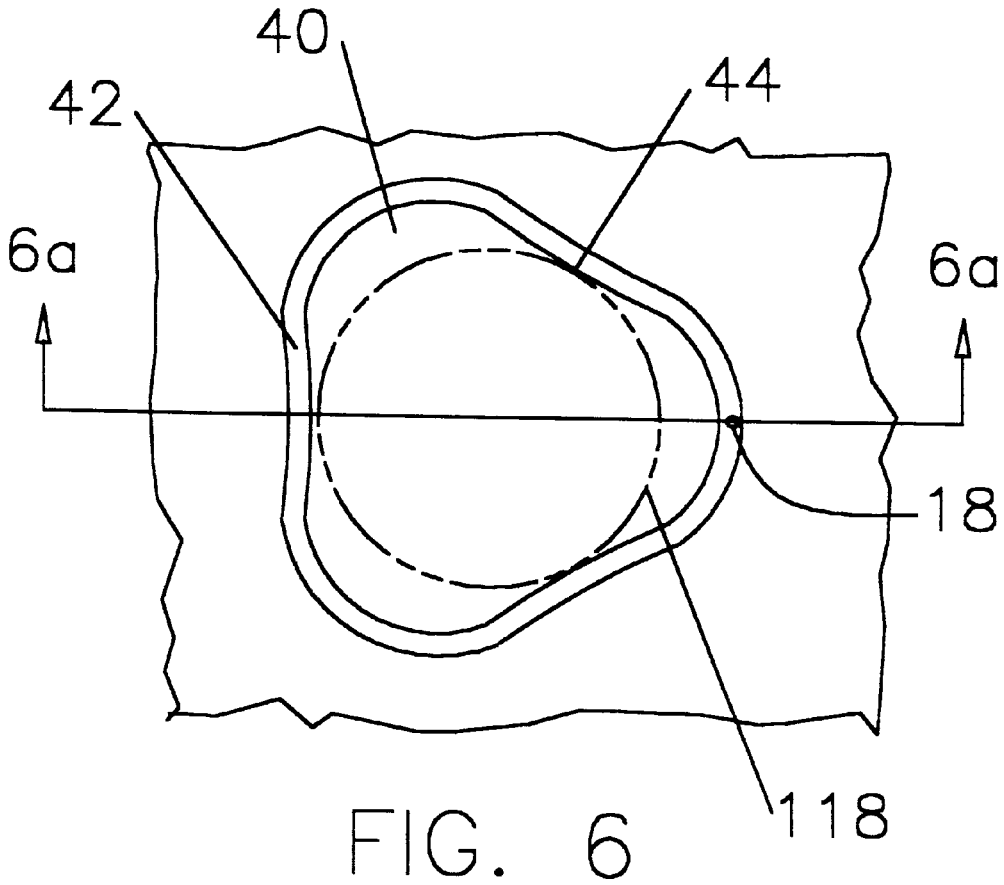
FIG. 6 is a top view of a fourth preferred embodiment of a cup cavity in accordance with the present invention.
Figure 6A:
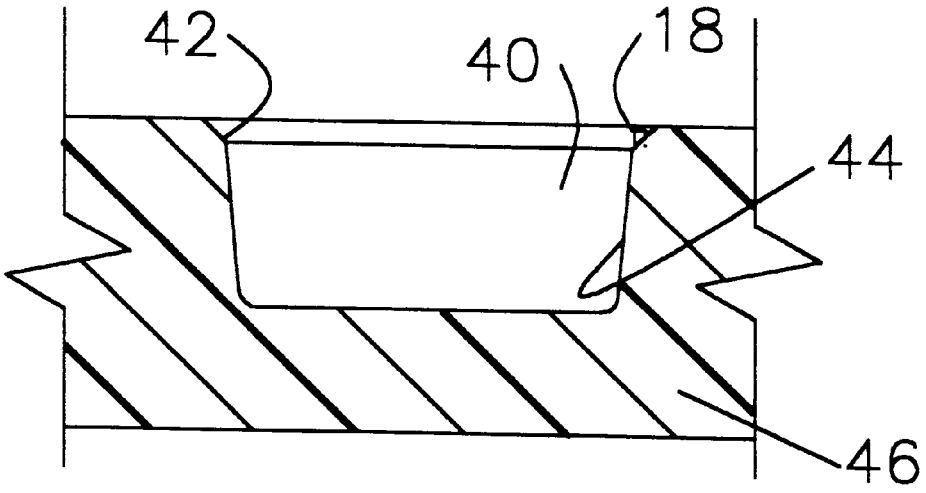
FIG. 6*a* is a cross-sectional view of a fourth preferred embodiment of a cup cavity in accordance with the present invention.

FIGS. 6 and 6*a* show a fourth preferred embodiment of a cup cavity 40. The cup cavity 40 has at least three substantially straight side walls 44. A chamfer 42 is preferably formed on the top perimeter of the cup cavity 40 to facilitate the insertion of a cup or can. The shape of the cup cavity eliminates the need for a vacuum relief vent. The substantially straight side walls 44 only make line contact with the cup or can 118. The shape of the cup cavity 40 should not be limited to that shown in FIG. 6. The only requirement is that the cup cavity 40 have at least three substantially straight side walls 44 which contact the can or cup 118. At least two cup cavities 40 are formed in a foam base 46. The nub protrusion 18 may be formed anywhere on the chamfer 42 to ensure that the top of the nub protrusion 18 after cutting does not reach the top of the foam base 46.

FIG. 7 shows a cross-sectional view of a cup 120 being inserted into a cup cavity 12 having a chamfer 16. The chamfer 16 facilitates the insertion of the cup 120 into the cup cavity 12. FIG. 7 illustrates the use of chamfers in cup cavity preferred embodiments 1–4.

Figure 8:
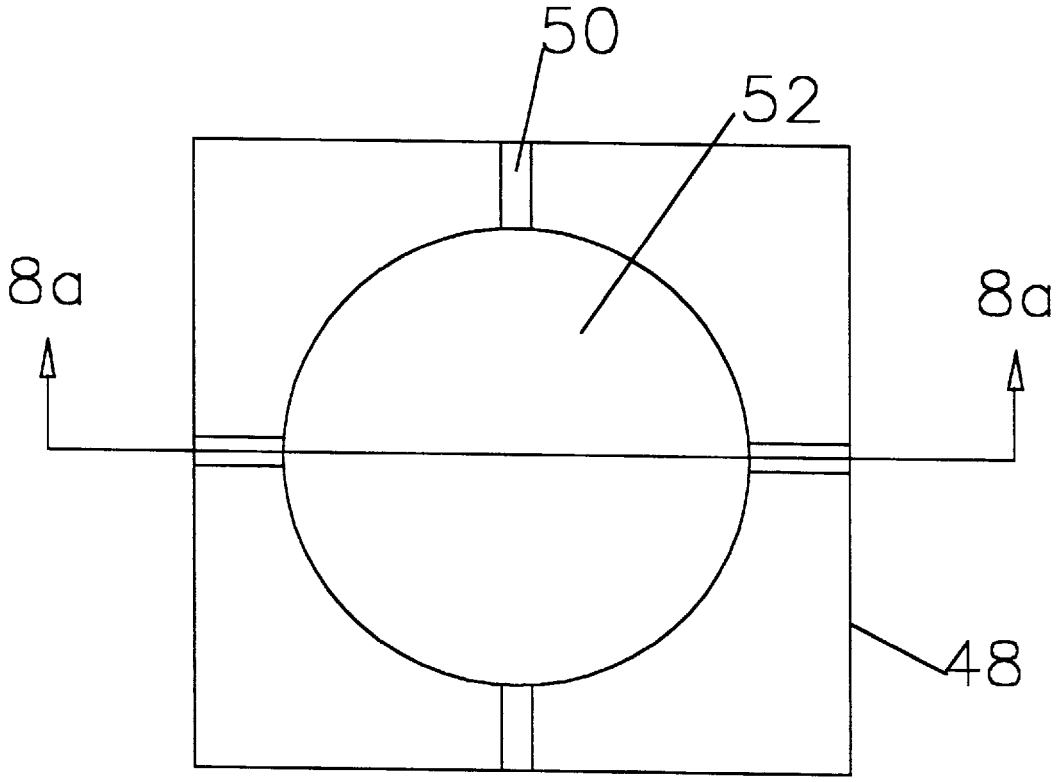
FIG. 8 is a top view of a tray mold half which has been modified with a gas relief vent in accordance with the present invention.
Figure 8A:
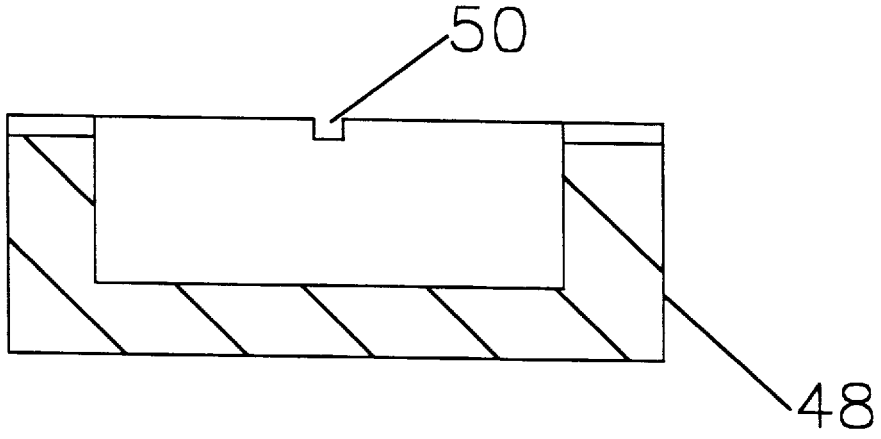
FIG. 8*a* is a cross-sectional view of a tray mold half which has been modified with a gas relief vent in accordance with the present invention.

FIGS. 8 and 8*a* show a tray mold half 48 which has been modified with at least one gas relief vent 50. The gas relief vent 50 allows gas to escape the mold area 52. The gas relief vent 50 will improve the flow of foam in the mold area 52. Foam strips will be formed on the edges of a complete tray as a result of each gas relief vent 50. The foam strips will be trimmed off after removal from the mold area 52. Preferably, each gas relief vent 50 is 0.25 inches wide and 0.03 inches deep. Other sizes and shapes of vents may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A foam drink tray with improved cup cavities comprising:

a foam base;

at least two cup cavities being formed in said foam base, each said cup cavity having a chamfer formed on a top perimeter thereof; and a gas escape hole being formed in the mold which forms said foam base, said gas escape hole being disposed in the mold such that a nub protrusion is formed on said chamfer, said nub protrusion having a height which does not exceed a top of said tray.

2. The foam drink tray with improved cup cavities of claim 1, further comprising:

said cup cavity being round in shape, said cup cavity having a draft to facilitate withdrawal from a mold.

3. The foam drink tray with improved cup cavities of claim 1, further comprising:

a hand cavity being formed at substantially the perimeter of said foam base, said hand cavity being shaped to allow said foam base to be firmly retained by a hand.

4. The foam drink tray with improved cup cavities of claim 1, further comprising:

an advertising logo being affixed to a bottom of said foam base.

5. The foam drink tray with improved cup cavities of claim 1, further comprising:

at least one cup cavity having a vacuum release vent disposed in a side wall thereof.

6. A foam drink tray with improved cup cavities comprising:

a foam base;

at least two cup cavities being formed in said foam base, each said cup cavity having at least one vacuum release vent formed in a side wall thereof, a chamfer being formed on a top of said cup cavity; and a gas escape hole being formed in the mold which forms said foam base, said gas escape hole being disposed in the mold such that a nub protrusion is formed on said chamfer, said nub protrusion having a height which does not exceed a top of said tray.

7. The foam drink tray with improved cup cavities of claim 6, further comprising:

said cup cavity being round in shape, said cup cavity having a draft to facilitate withdrawal from a mold.

8. The foam drink tray with improved cup cavities of claim 6, further comprising:

a hand cavity being formed at substantially the perimeter of said foam base, said hand cavity being shaped to allow said foam base to be firmly retained by a hand.

9. The foam drink tray with improved cup cavities of claim 6, further comprising:

an advertising logo being affixed to a bottom of said foam base.

10. A foam drink tray with improved cup cavities comprising:

a foam base;

at least two cup cavities being formed in said foam base, each said cup cavity having at least one vacuum release vent formed in a side wall thereof, a chamfer being formed on a top of said cup cavity; and a gas escape hole being formed in the mold which forms said foam base, said gas escape hole being disposed in the mold such that a nub protrusion is formed on said chamfer, said nub protrusion having a height which does not exceed a top of said tray.

11. The foam drink tray with improved cup cavities of claim 10, further comprising:

said cup cavity being round in shape, said cup cavity having a draft to facilitate withdrawal from a mold.

12. The foam drink tray with improved cup cavities of claim 10, further comprising:

a hand cavity being formed at substantially the perimeter of said foam base, said hand cavity being shaped to allow said foam base to be firmly retained by a hand.

13. The foam drink tray with improved cup cavities of claim 10, further comprising:

an advertising logo being affixed to a bottom of said foam base.

* * * * *